US006961974B1

(12) United States Patent
Goolsby, Jr.

(10) Patent No.: US 6,961,974 B1
(45) Date of Patent: Nov. 8, 2005

(54) PIPE PREPPING TOOL

(76) Inventor: Lloyd E. Goolsby, Jr., 5150 Gaynor Rd., Eight Mile, AL (US) 36613

( * ) Notice: Subject to any disclaimer, the term of this patent is extended or adjusted under 35 U.S.C. 154(b) by 381 days.

(21) Appl. No.: 10/261,104

(22) Filed: Oct. 1, 2002

(51) Int. Cl.[7] ..... B08B 9/02
(52) U.S. Cl. ..... 15/104.04; 15/22.1; 15/104.05; 15/104.16; 15/160
(58) Field of Search ..... 15/22.1, 23, 88, 15/104.04, 104.05, 104.095, 160, 104.16, 15/106; 451/358, 178, 180

(56) References Cited

U.S. PATENT DOCUMENTS 5,307,534 A * 5/1994 Miller ..... 15/4
5,946,757 A * 9/1999 Oliveira ..... 15/104.04
6,745,425 B1 * 6/2004 Tope ..... 15/104.04

* cited by examiner

*Primary Examiner*—John Kim
*Assistant Examiner*—Abraham Bahta

(57) ABSTRACT

A pipe prepping tool for cleaning the ends of copper pipes and fittings to prepare their surfaces for soldering. The pipe prepping tool includes a hand-held housing member having an elongate handle portion and a head portion; and also includes a first brush support member being rotatably mounted to the hand-held housing member; and further includes a second brush support member being mounted to the first brush support member; and also includes a plurality of brushes being supported by the first and second brush support members for prepping threads and interior surface of a pipe; and further includes an assembly of rotating said brush members.

6 Claims, 4 Drawing Sheets

PIPE PREPPING TOOL

BACKGROUND OF THE INVENTION

1. Field of the Invention

The present invention relates to pipe cleaners and more particularly pertains to a new pipe prepping tool for cleaning the ends of copper pipes and fittings to prepare their surfaces for soldering.

2. Description of the Prior Art

The use of pipe cleaners is known in the prior art. More specifically, pipe cleaners heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,269,104; U.S. Pat. No. 5,307,534; U.S. Pat. No. 5,791,005; U.S. Pat. No. 3,188,674; U.S. Pat. No. 5,908,253; and U.S. Pat. No. Des. 347,523.

While these devices fulfill their respective, particular objectives and requirements, the aforementioned patents do not disclose a new pipe prepping tool. The prior art includes inventions having brushes attached to shafts which are rotated by motors.

SUMMARY OF THE INVENTION

The general purpose of the present invention, which will be described subsequently in greater detail, is to provide a new pipe prepping tool which has many of the advantages of the pipe cleaners mentioned heretofore and many novel features that result in a new pipe prepping tool which is not anticipated, rendered obvious, suggested, or even implied by any of the prior art pipe cleaners, either alone or in any combination thereof. The present invention includes a hand-held housing member having an elongate handle portion and a head portion; and also includes a first brush support member being rotatably mounted to the hand-held housing member; and further includes a second brush support member being mounted to the first brush support member; and also includes a plurality of brushes being supported by the first and second brush support members for prepping threads and interior surface of a pipe; and further includes an assembly of rotating said brush members. None of the prior art includes the combination of the elements of the present invention.

There has thus been outlined, rather broadly, the more important features of the pipe prepping tool in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new pipe prepping tool which has many of the advantages of the pipe cleaners mentioned heretofore and many novel features that result in a new pipe prepping tool which is not anticipated, rendered obvious, suggested, or even implied by any of the prior art pipe cleaners, either alone or in any combination thereof.

Still another object of the present invention is to provide a new pipe prepping tool for cleaning the ends of copper pipes and fittings to prepare their surfaces for soldering.

Still yet another object of the present invention is to provide a new pipe prepping tool that is easy and convenient to set up and use.

Even still another object of the present invention is to provide a new pipe prepping tool that is much more efficient and effective than the users cleaning the pipes by hand.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
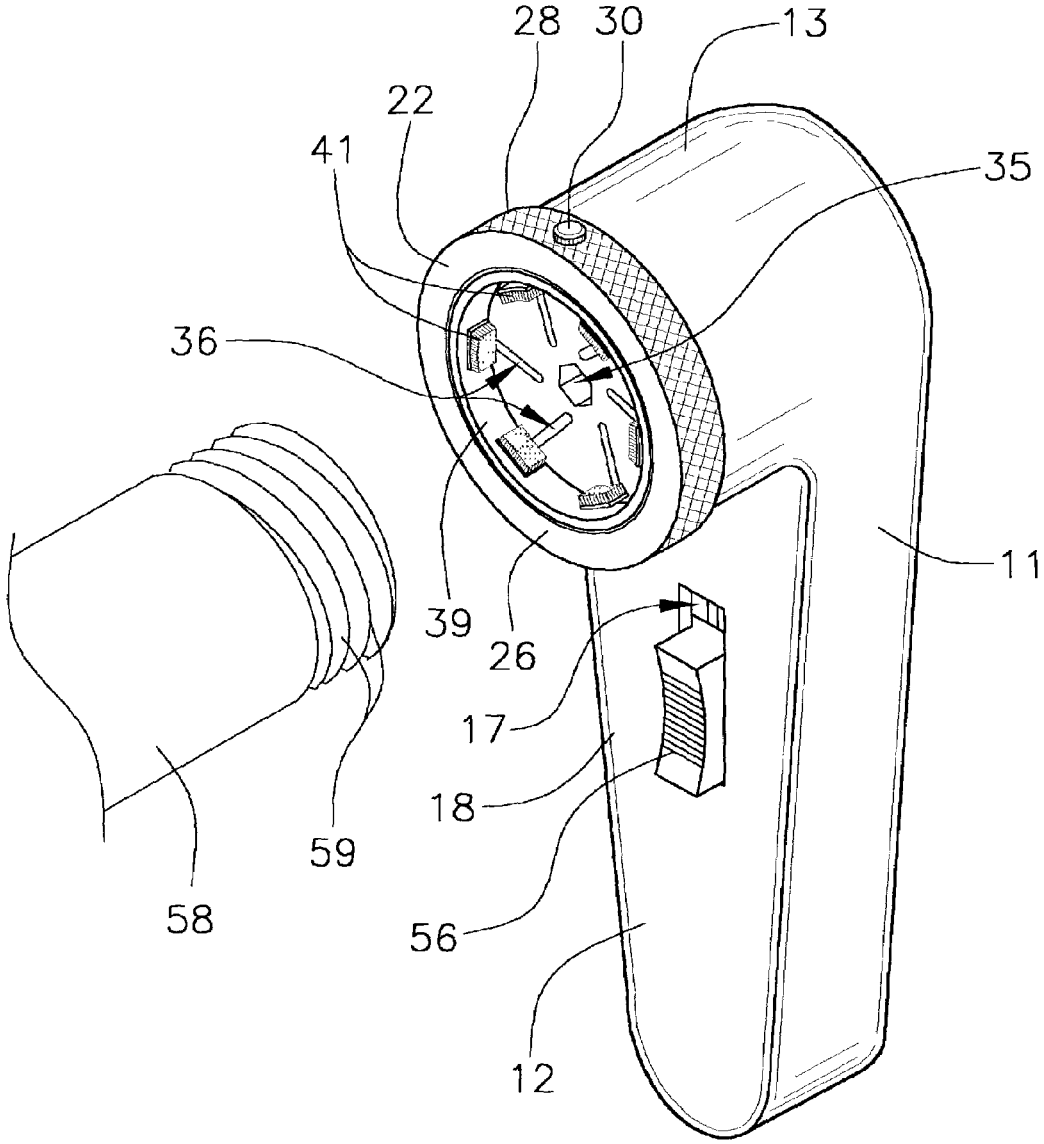
FIG. 1 is a front elevational view of a new pipe prepping tool according to the present invention.
Figure 2:
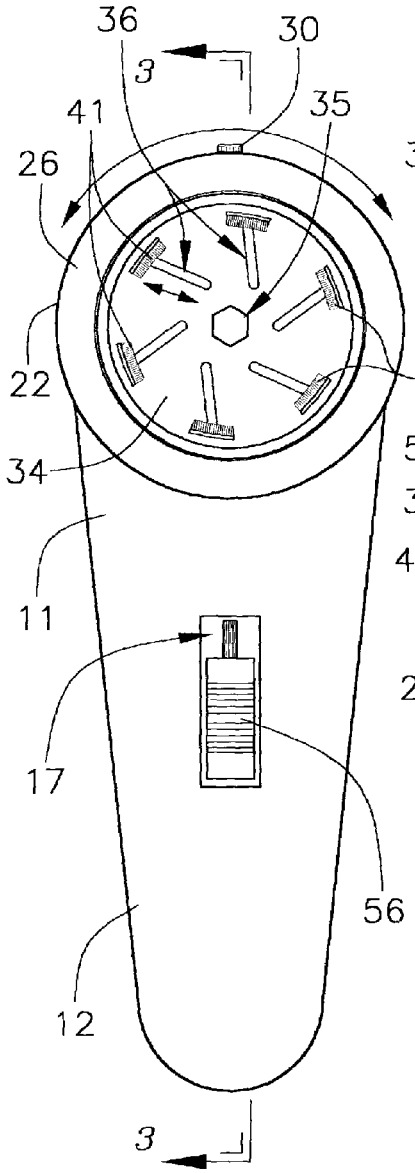
FIG. 2 is a front elevational view of the present invention.
Figure 3:
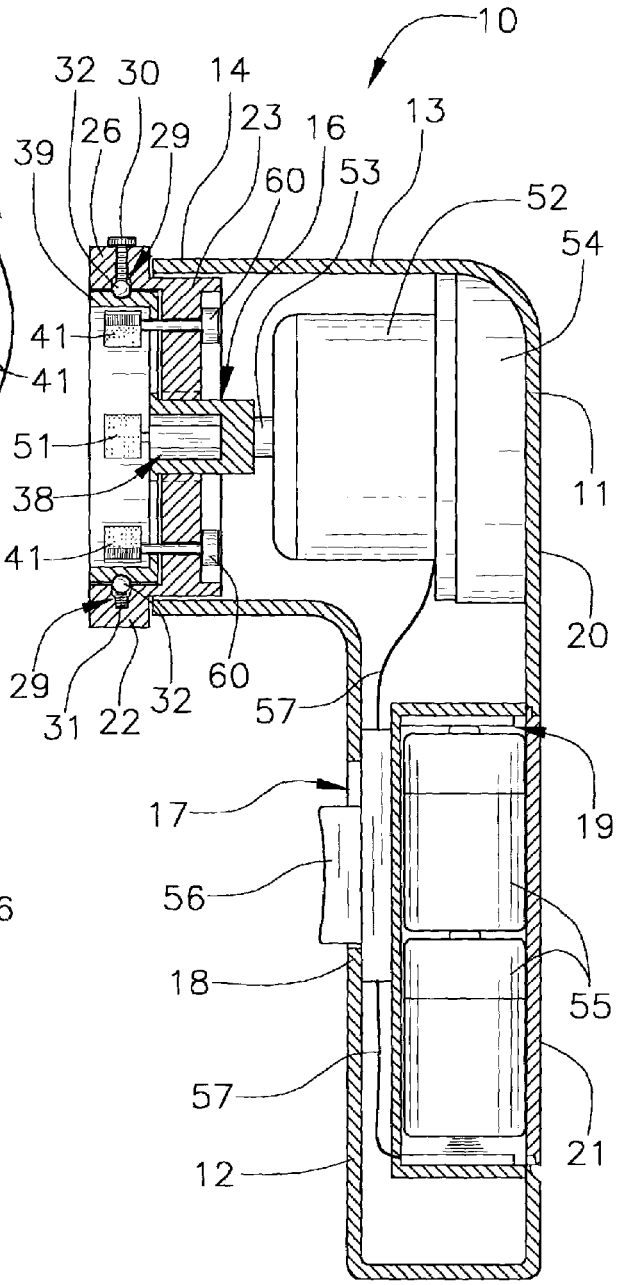
FIG. 3 is a cross-sectional view of the present invention.
Figure 4:
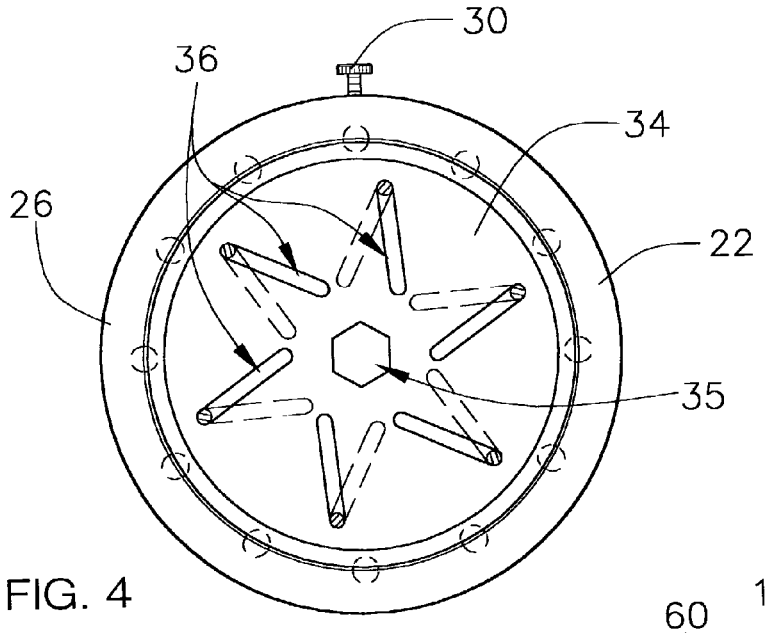
FIG. 4 is a front elevational view of the first and second brush support members of the present invention.
Figure 5:
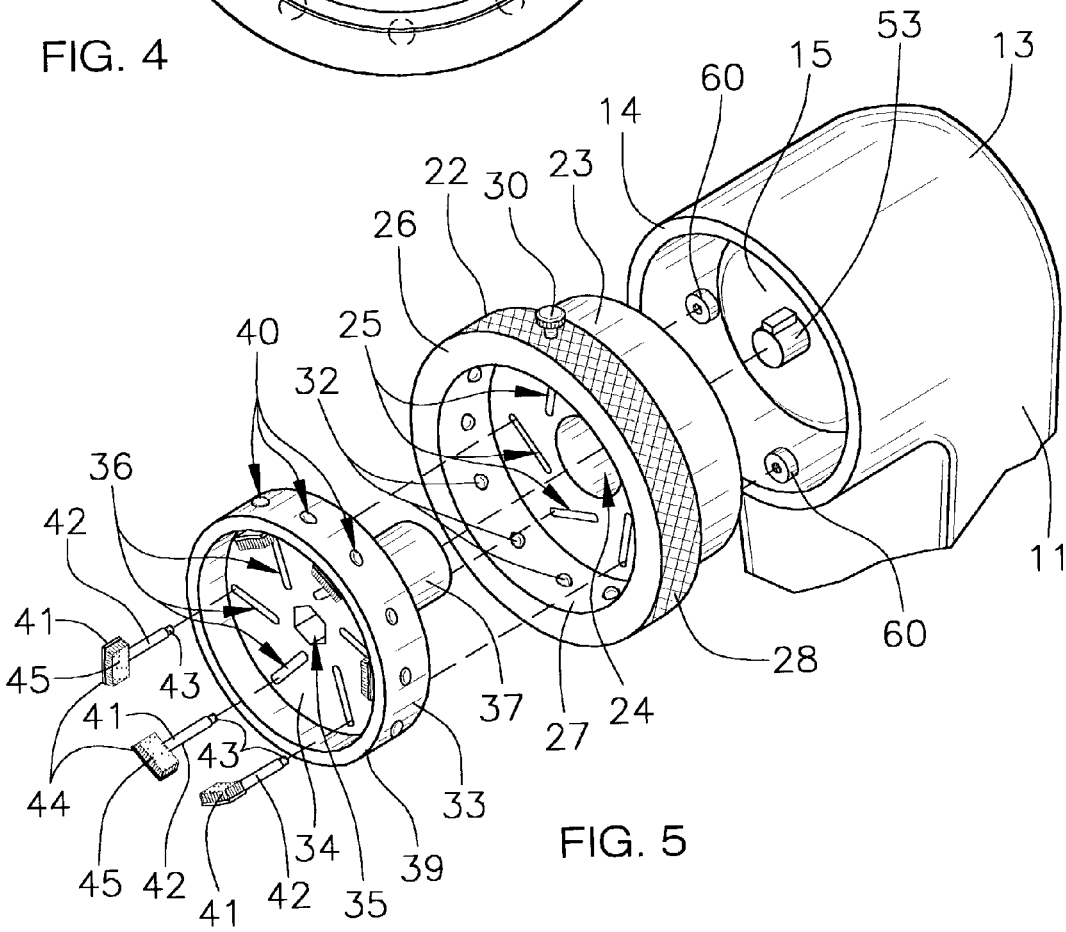
FIG. 5 is an exploded perspective view of the present invention.
Figure 6:
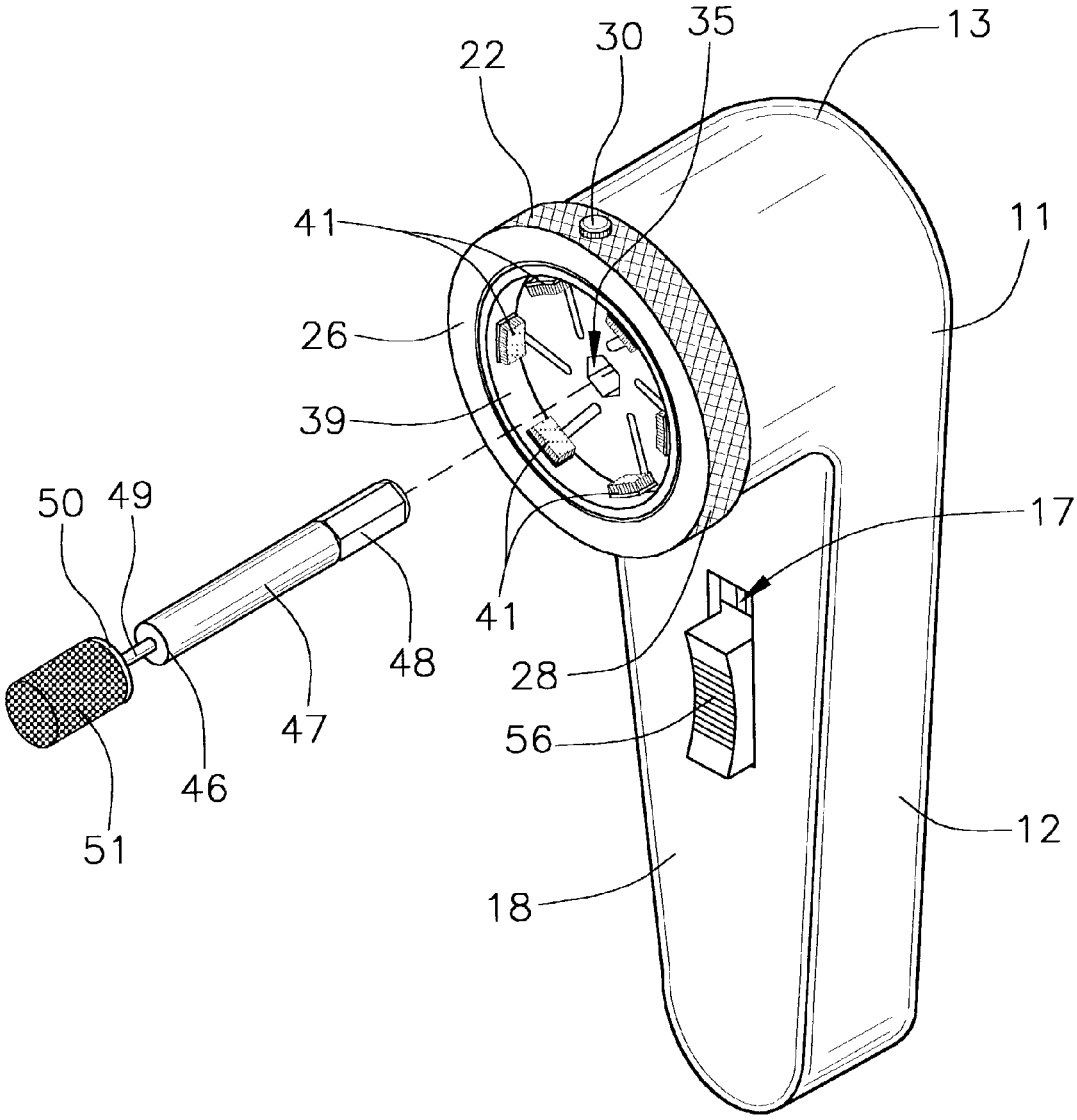
FIG. 6 is a partial exploded perspective view of the present invention.

With reference now to the drawings, and in particular to FIGS. 1 through 6 thereof, a new pipe prepping tool embodying the principles and concepts of the present invention and generally designated by the reference numeral 10 will be described.

At best illustrated in FIGS. 1 through 6, the pipe prepping tool 10 generally comprises a hand-held housing member 11 having an elongate handle portion 12 and a head portion 13. The head portion 13 has an extended tubular-shaped end portion 14 having an open end and a closed end 15, and the handle portion 12 has a slot 17 being disposed through a front wall 18 thereof and also has a battery compartment 19 being conventionally disposed therein and being accessible through a compartment opening in a back wall 20 thereof with the compartment opening being closed with a cover 21.

A first brush support member 22 is rotatably and conventionally mounted to the hand-held housing member 11. The first brush support member 22 includes a disc-shaped portion 23 having a hole 24 being centrally disposed therethrough and also having a plurality of first slots 25 being spacedly disposed therethrough and arranged about the hole 24 thereof, and also includes a first ring portion 26 having an inner surface 27 and an outer surface 28 and also having a plurality of slots 29 being spacedly disposed in the inner surface 27, and further includes a fastener 30 being threaded through the first ring portion 26, and also includes a plurality of springs 31 being securely and conventionally retained in the slots 29 of the first ring portion 26, and further includes a plurality of ball-shaped fastening members 32 being conventionally attached to the springs 31 and being biasedly disposed outwardly of the slots 29 of the first ring portion 26.

A second brush support member 33 is conventionally mounted to the first brush support member 22. The second brush support member 33 includes a wall 34 having a hole 35 being disposed therethrough and also having a plurality of second slots 36 being spacedly disposed through the wall 34 and being arranged about the hole 35 of the wall 34, and also includes a shaft portion 37 integrally extending from the wall 34 and having a bore 38 extending therethrough and being aligned with the hole 35 through the wall 34 of the second brush support member 33, and further includes a second ring portion 39 having a plurality of notches 40 being spacedly disposed in an outer surface thereof and receiving the ball-shaped fastening members 32 for retaining the second brush support member 33 in the first ring portion 26 of the first brush support member 22.

A plurality of brushes 41,46 are supported by the first and second brush support members 22,33 for prepping the threads 59 and interior surface of a pipe 58. The brushes 41,46 include first brush members 41 being fastenably received through the first and second slots 25,36 of the first and second brush support members 22,33 for prepping the threads 59 on the pipe 58, and also includes a second brush member 46 being removably and securely received through the holes 24,35 of the first and second brush support members 22,33 and through the bore 38 of the shaft 37 of the second brush support member 33. Each of the first brush members 41 includes a stem 42 having a threaded end portion 43 and being extended through a respective the first and second slots 25,36, and also includes brush head 44 being conventionally attached to the stem 42 and having a plurality of wire bristles 45 conventionally extending outwardly from the brush head 44, and further includes a fastener member 60 being threaded upon the threaded end portion 43 for fastening the first brush member 41 to the first and second brush support members 22,33. Each of the second brush members 46 includes a shaft 47 having a multi-sided end portion 48 and being engaged in the holes 24,35 of the first and second brush support members 22,33 and in the bore 38 of shaft portion 37, and also includes a stem member 49 being conventionally attached at an end of the shaft 47, and further includes a brush head member 50 being conventionally attached to the stem member 49 and having a plurality of wire bristles members 51 being conventionally attached to the brush head member 50 for cleaning inside the pipe 58.

A means of rotating the brush members 41,46 includes a motor 52 being securely and conventionally mounted with a bracket 54 in the head portion 13 of the hand-held housing member 11 and having a shaft 53 rotatably and conventionally attached to the motor 52 and being disposed through the hole 16 of the closed end 15 of extended tubular-shaped end portion 14, and also includes one or more batteries 55 being conventionally disposed in the battery compartment 19 for energizing the motor 52, and further includes a switch 56 being movably and conventionally disposed in the slot 17 of the handle portion 12 and being conventionally connected to the motor 52 and to the one or more batteries 55 with wires 57 for the energizing of the motor 52. The first and second brush support members 22,33 are securely and conventionally mounted upon the shaft 53, for rotation therewith.

In use, the user extends the brushes 41,47 about the threads 59 of the pipe 58 and also in the pipe 58, and turns on the motor 52 using the switch 56 which rotates the shaft 53 and the brushes 41,46 to scour and clean those particular areas of the pipe 58.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the pipe prepping tool. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pipe prepping tool comprising:

a hand-held housing member having an elongate handle portion and a head portion, said head portion having an extended tubular-shaped end portion having an open end and a closed end with a hole being centrally disposed through said closed end, and said handle portion having a slot being disposed through a front wall thereof and also having a battery compartment being disposed therein and being accessible through a compartment opening in a back wall thereof, said compartment opening being closed with a cover;

a first brush support member being rotatable mounted to said hand-held housing member, said first brush support member including a disc-shaped portion having a hole being centrally disposed therethrough and also having a plurality of first slots being spacedly disposed therethrough and arranged about said hole thereof, and also including a first ring portion having an inner surface and an outer surface and also having a plurality of slots being spacedly disposed in said inner surface, and further including a fastener being threaded through said first ring portion, and also including a plurality of springs being securely retained in said slots of said first ring portion, and further including a plurality of ball-shaped fastening members being attached to said springs and being biasedly disposed outwardly of said slots of said first ring portion;

a second brush support member being mounted to said first brush support member;

a plurality of brushes being supported by said first and second brush support members for prepping threads and interior surface of a pipe; and a means of rotating said brush members.

2. A pipe prepping tool as described in claim 1, wherein said second brush support member includes a wall having a hole being disposed therethrough and also having a plurality of second slots being spacedly disposed through said wall and being arranged about said hole of said wall, and also includes a shaft portion extending from said wall and having a bore extending therethrough and being aligned with said hole through said wall of said second brush support member, and further includes a second ring portion having a plurality of notches being spacedly disposed in an outer surface thereof and receiving said ball-shaped fastening members for retaining said second brush support member in said first ring portion of said first brush support member.

3. A pipe prepping tool as described in claim 2, wherein brushes include first brush members being fastenably received through said first and second slots of said first and second brush support members for prepping the threads on the pipe, and also includes a second brush member being removably and securely received through said holes of said first and second brush support members and through said bore of said shaft of said second brush support member.

4. A pipe prepping tool as described in claim 3, wherein each of said first brush members includes a stem having a threaded end portion and being extended through a respective said first and second slots, and also includes brush head being attached to said stem and having a plurality of wire bristles extending outwardly from said brush head, and further includes a fastener member being threaded upon said threaded end portion for fastening said first brush member to said first and second brush support members.

5. A pipe prepping tool as described in claim 4, wherein each of said second brush members includes a shaft having a multi-sided end portion and being engaged in said holes of said first and second brush support members and in said bore of shaft portion, and also includes a stem member being attached at an end of said shaft, and further includes a brush head member being attached to said stem member and having a plurality of wire bristles members being attached to said brush head member for cleaning inside the pipe.

6. A pipe prepping tool as described in claim 5, wherein said means of rotating said brush members includes a motor being securely mounted with a bracket in said head portion of said hand-held housing member and having a shaft rotatably attached to said motor and being disposed through said hole of said closed end of extended tubular-shaped end portion, and also includes one or more batteries being disposed in said battery compartment for energizing said motor, and further includes a switch being movably disposed in said slot of said handle portion and being connected to said motor and to said one or more batteries with wires for the energizing of said motor, said first and second brush support members being mounted upon said shaft of said motor.

* * * * *